US010258111B2

(12) United States Patent
Wetsch et al.

(10) Patent No.: US 10,258,111 B2
(45) Date of Patent: Apr. 16, 2019

(54) INFLATABLE SHOE INSERT

(71) Applicant: Pregis Innovative Packaging LLC, Deerfield, IL (US)

(72) Inventors: Thomas Wetsch, St. Charles, IL (US); Kark Katsuhiko Yoshifusa, Lake Forest, CA (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 8 days.

(21) Appl. No.: 15/266,918

(22) Filed: Sep. 15, 2016

(65) Prior Publication Data

US 2017/0071292 A1 Mar. 16, 2017

Related U.S. Application Data

(60) Provisional application No. 62/219,108, filed on Sep. 15, 2015.

(51) Int. Cl.
*A43D 3/04* (2006.01)
*A43D 3/14* (2006.01)

(52) U.S. Cl.
CPC ..... *A43D 3/1433* (2013.01); *A43D 3/04* (2013.01)

(58) Field of Classification Search
CPC ..... A43D 3/04; A43D 3/1433; A43B 17/03; A43B 17/026
USPC ..... 12/114.2, 114.4, 128 R; 36/43, 44
See application file for complete search history.

(56) References Cited

U.S. PATENT DOCUMENTS 1,086,782 A * 2/1914 Moore ..... A43D 3/04 12/114.4
2,310,847 A * 2/1943 Grau-Kupfer ..... A43D 3/1408 12/114.4
2,538,247 A * 1/1951 Holt ..... A43D 3/04 12/114.4
2,917,807 A * 12/1959 Scholl ..... A43B 13/12 36/44
3,729,759 A * 5/1973 Szabo ..... A43D 3/04 12/114.4
3,765,422 A * 10/1973 Smith ..... A43B 17/03 36/153
D258,699 S * 3/1981 McPherson ..... 12/114.4
(Continued)

FOREIGN PATENT DOCUMENTS

DE 2443859 A1 3/1976
DE 3805721 A1 12/1988
WO 9008487 A1 8/1990

*Primary Examiner* — Marie D Bays
(74) *Attorney, Agent, or Firm* — Dorsey & Whitney LLP

(57) ABSTRACT

Provided is an inflatable shoe insert for inserting in a shoe. The insert comprises first and second web plies that are sealed together at a plurality of seals that define an air chamber. The air chamber includes a front region having a toe expansion region uninterrupted by seals over an area so that when fully inflated, the front region expands to a height and medial-lateral width to support the shoe upper against collapsing. The air chamber further includes a retention portion having a region in which the seals are spaced closer together than in the toe expansion region so that when fully inflated, the retention portion expands to a medial-lateral width that is smaller than that in the toe expansion region, the retention portion having an anterior-posterior length that reaches the heel of the shoe to retain the front region in the toe box by pressure against the heel.

18 Claims, 11 Drawing Sheets

(56) References Cited

U.S. PATENT DOCUMENTS

| | | | | |
|---|---|---|---|---|
| 4,400,840 | A | 8/1983 | Sly et al. | |
| 4,567,677 | A * | 2/1986 | Zona | A43B 13/20 36/28 |
| 5,067,255 | A * | 11/1991 | Hutcheson | A43B 17/026 36/28 |
| 5,167,999 | A * | 12/1992 | Wang | A43B 7/1425 36/30 R |
| 5,341,532 | A * | 8/1994 | Markowitz | A43D 3/04 12/114.4 |
| 5,878,510 | A * | 3/1999 | Schoesler | A43B 7/147 36/153 |
| 6,338,768 | B1 * | 1/2002 | Chi | A43B 13/188 12/142 K |
| 6,453,577 | B1 * | 9/2002 | Litchfield | A43B 13/203 36/29 |
| 6,505,420 | B1 * | 1/2003 | Litchfield | A43B 13/203 36/28 |
| 6,971,135 | B2 | 12/2005 | Nadler | |
| 7,930,837 | B1 * | 4/2011 | Huebner | A42B 1/002 12/114.4 |
| 8,099,879 | B1 * | 1/2012 | Huebner | A42B 3/006 12/114.2 |
| 2005/0241185 | A1 * | 11/2005 | Flood | A43B 7/1415 36/29 |
| 2006/0005328 | A1 * | 1/2006 | Johnson | A43D 3/1433 12/128 R |
| 2009/0165333 | A1 * | 7/2009 | Litchfield | A43B 13/203 36/88 |
| 2014/0230273 | A1 * | 8/2014 | Evans, Jr. | A43B 7/146 36/43 |

* cited by examiner

INFLATABLE SHOE INSERT

CROSS REFERENCE TO RELATED APPLICATIONS

The present application claims priority to U.S. provisional application No. 62/219,108 filed Sep. 15, 2015 entitled "Inflatable Shoe Insert," the disclosure of which is hereby incorporated by reference in its entirety.

FIELD OF DISCLOSURE

The present disclosure relates to packaging materials used in shoes. More particularly, the present disclosure is directed to devices and methods for manufacturing inflatable cushions to be used as packaging material for shoes.

BACKGROUND

Shoes are produced and typically shipped in paperboard cartons for transportation and sale. Typically, shoe cartons are stacked; and so to protect the shoes from getting crushed, many producers insert paper wadding, molded pulp shapes, or other combinations of materials to maintain the form factor of the shoe. If the shoes are not filled, then during long shipping cycles the shoes will take or form memory in various shapes that will not meet the consumer esthetics when they try on the shoes. The use of molded pulp or crumpled paper not only is used as filler to retain the shape but it has no memory and can be crushed during transportation and storage. These materials also do not have the consumer appeal and marketing that shoe companies are after today. They also carry extra weight and cost when used as a filler. Recently, alternatives have come to market such as blow molded shapes made to try to fill out the cavity of the shoe to maintain the shape, but they do not have the ability to cover a range of sizes without individual forms being made. Also, some inflated products have been inserted into boots to keep the calf portion of the boot upright and reduce wrinkles or folds in the leather. Combinations of paper, molded pulp and paper sticks have also been used. An improved protective shoe insert is thus desired.

SUMMARY

Provided is inflatable shoe insert for inserting in a shoe. The insert includes first and second web plies that are sealed together at a plurality of seals that define an air chamber therebetween. The air chamber includes a front region having a toe expansion region that is uninterrupted by seals over an area that is sufficiently large so that when fully inflated, the front region expands to an inflation height and a medial-lateral width sufficient to support the shoe upper of the shoe against collapsing. The air chamber further includes a posterior retention portion in fluid communication with the front region and having an retention expansion region in which the seals are spaced closer together than in the toe expansion region so that when fully inflated. The retention portion expands to a medial-lateral width that is smaller than that in the toe expansion region, and the retention portion has an anterior-posterior length configured to reach the heel of the shoe to retain the front region in the toe box by pressure against the heel.

Also provided is a web for an inflatable shoe insert for inserting in a shoe. The shoe insert comprises first and second web plies that are sealed together at a plurality of seals that define a plurality of air chambers therebetween, and an inflation area connecting the air chambers to direct the fluid into the air chambers to inflate the chambers. The web includes first separation region extending substantially completely across the web between first pairs of adjacent air chambers, the separation region facilitating separation of the air chambers of the first pairs from each other, and a second separation region extending across the web and stopping short of the inflation area between second pairs of adjacent air chambers, the second separation region facilitating partial separation of the air chambers of the of the second pairs from each other while leaving the air chambers of the second pair attached at the inflation area.

DETAILED DESCRIPTION

Figure 1A:
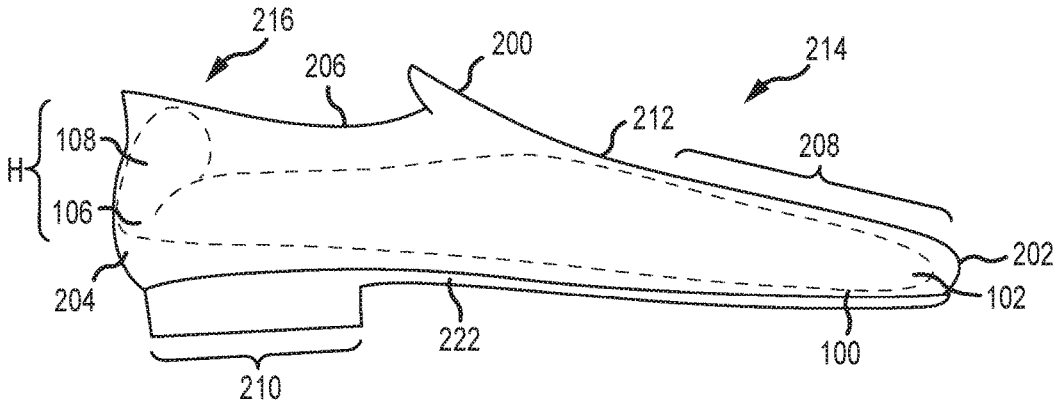
FIG. 1A is a side view of a shoe with a shoe insert disposed therein.

The present disclosure is related to shoe-packaging inserts for preserving the shape of a shoe and reducing deforming during shipping. Illustrative embodiments will now be described to provide an overall understanding of the disclosed apparatus. Those of ordinary skill in the art will understand that the disclosed apparatus can be adapted and modified to provide alternative embodiments of the apparatus for other applications, and that other additions and modifications can be made to the disclosed apparatus without departing from the scope of the present disclosure. For example, features of the illustrative embodiments can be combined, separated, interchanged, and/or rearranged to generate other embodiments. Such modifications and variations are intended to be included within the scope of the present disclosure.

In some embodiments, provided are pressurized shoe inserts that fill out a shoe area and that are narrow enough to flex at the rear portion of the shoe, in order to maintain the form of the shoe at the front portion (e.g., the toe box and tongue) and the rear portion (e.g., the heel box and back member). The air shapes can be configured to fit a range of shoe sizes or lengths with a flexible posterior portion that may bend to adapt to the shoe size. For example, the inserts may include a front region to fill a front portion of a shoe, and a posterior portion that extends to the rear portion of the shoe, to provide support. The posterior portion may be flexible to allow the insert to fit into various shoe sizes. For example, the posterior-anterior length of the insert may be longer than that of the shoe cavity, and a user can bend the posterior portion 90 degrees at the heel of the insert so that the insert fits into the shoe cavity. The inserts may be resilient to return to their shape, even after being compressed. The disclosed inserts help retain the shape of shoes, even as the shoes experience compressive forces (e.g., are crushed) and/or move during shipping.

In accordance with various embodiments, the inserts are flexible. For example, in some embodiments, the inserts 100 are sufficiently flexible so that they easily bend under their own weight. The inserts may be sufficiently flexible so that they can be bent into different shapes without permanently distorting, cracking, or breaking.

The disclosed inserts may allow shoes to be shipped and/or stored more densely than in cardboard boxes that contain a single pair of shoes. For example, shoes containing inserts may be shipped in a bag, or other exterior packaging, that contains a plurality of shoes. Thus, the inserts may allow shoes to be transported and/or stored in a more efficient and cost effective manner.

In some embodiments, the inflated pressurized inserts are provided that retain air pressure throughout shipment cycles, which can exceed 90 days. Some materials are selected for a greater or lesser number of days in which they will remain sufficiently inflated. Some embodiments comprise inflating the inserts via a one-way valve to facilitate manufacturing. Also, multilayer web material, such as co-extruded material that contains nylon may be used for extended air retention under pressure that lasts through the shipping and storage of the shoes.

Figure 1B:
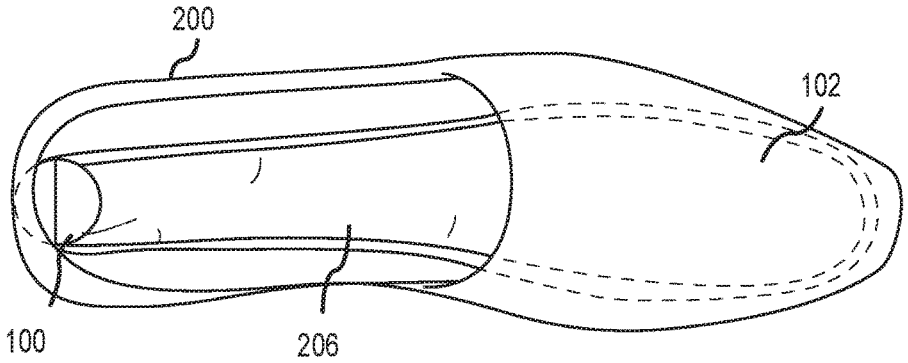
FIG. 1B is a top view of a shoe with a shoe insert disposed therein.

FIGS. 1A and 1B are side and top views of a shoe 200 with a shoe insert 100 disposed therein, according to an embodiment. The shoe 200 has a shoe cavity 206 that is configured for receiving a wearer's foot. A front portion 214 includes a toe box 208 that is configured to receive the wearer's toes, and which has a toe 202 at the anterior end of the shoe 200. A rear portion 216 of the shoe includes a heel box 210 that is configured to receive the wearer's heel, and which has a back member 204 at the posterior end of the shoe 200. The front portion 214 may include a vamp 212 that is configured to crease as the wearer bends his or her foot. In some shoes, the front portion 214 includes quarters with eyelets that come together when tied with shoe laces (not shown). In some embodiments, the shoe insert 100 is configured to flex and fill the shoe cavity 206, in order to maintain the structural form of the shoe during shipping and/or storing. The shoe insert 100 can form to the shoe 200 to fill out the various widths in the front portion 214 and provide stiffness back to the rear portion 216 to maintain a flat and formed shoe 200.

The insert 100 includes a front region 102 and a posterior retention portion 104. The posterior retention portion 104 can include a flexible region 106 and a heel portion 108. The insert 100 is configured such that when it is inserted in the shoe cavity 206, the insert 100 provides rigidity to the shoe 200. The front region 102 can provide support to front portion 214 of the shoe 200. For example, the front region 102 reduces or prevents sagging or drooping of the front portion 214 inward into the shoe cavity 206. The heel portion 108 can provide support to the rear portion 216 of the shoe 200, for example, to the heel box 210. For example, the heel portion 108 can reduce or prevent sagging or drooping of the rear portion 216 downwards toward the sole 222 of the shoe 200. As shown in FIG. 1B, the shoe 200 extends towards the toe 202 in the anterior direction and towards the back member 204 in the posterior direction. FIG. 1B is a left shoe 200, as it extends in the medial direction towards a wearer's right shoe and it extends in the lateral direction away from the wearer's right shoe. The shoe 200 herein described with reference to FIGS. 1A and 1B is exemplary, and the insert 100 may work with other suitable types and embodiments of shoes.

As shown in FIGS. 1A and 1B, in some embodiments, the length of the insert 100 in the posterior-anterior direction is greater than that of the shoe cavity 206. Thus, the insert 100 flexes or bends to fit into the shoe cavity 206. For example, in some embodiments, the posterior retention portion 104 of the insert 100 flexes or bends at an angle equal to, or about equal to, 90 degrees, in order to force the front region 102 of the insert 100 up into the front portion 214 of the shoe. In some embodiments, the flexible region 106 bends or flexes such that a bottom portion of the heel portion 108 abuts and exerts pressure on the back member 204 of the shoe 200.

Figure 2:
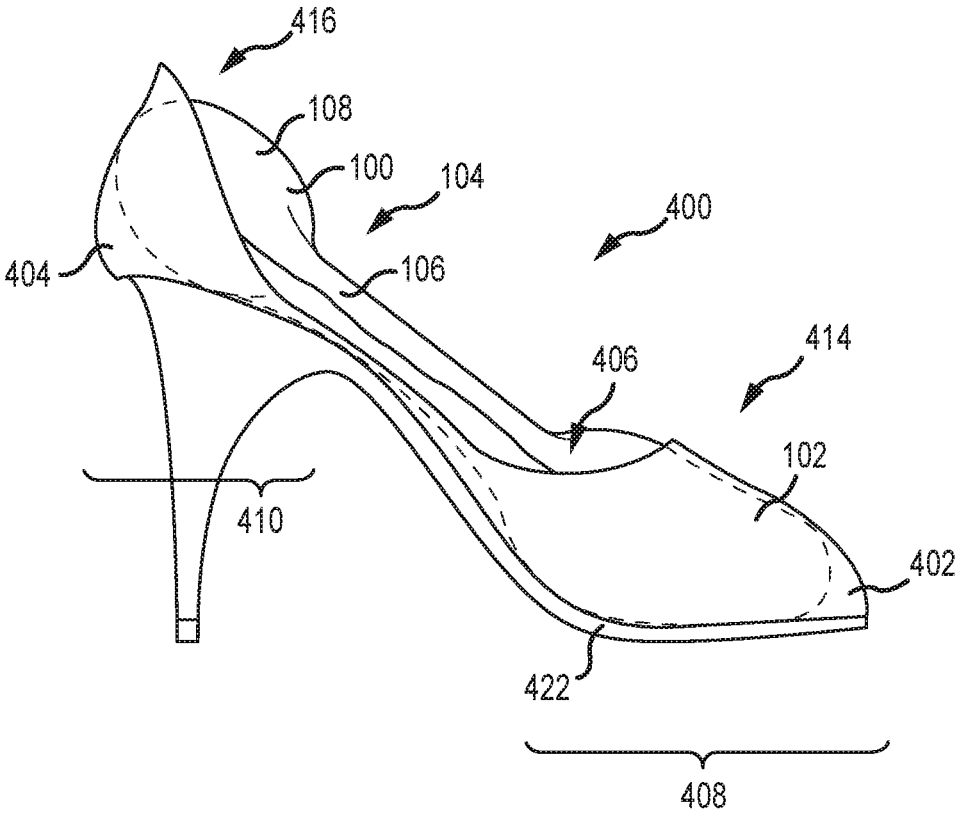
FIG. 2 is a side view of a women's shoe with a shoe insert disposed therein.

FIG. 2 shows a women's shoe 400 with an insert 100 disposed therein, according to an embodiment. The women's shoe 400 includes a front portion 414, including a toe box 408 having a toe 402, and a rear portion 416, including heel box 410 having a back member 404. The insert 100 is configured such that when it is inserted in the shoe cavity 406, the insert 100 provides rigidity to the shoe 400. The front region 102 provides support to the front portion 414. For example, the front region 102 can reduce or prevent sagging or dropping of the toe box 408 inward into the shoe cavity 406. The heel portion 408 can provide support to the heel box 410. For example, the heel portion 108 can reduce or prevent sagging or drooping of the heel box 410 downwards toward the sole 422 of the shoe 400.

The insert 100 may also be used to retain the shape of sandals. For example, the front region 102 can be configured to keep a strap of a sandal elevated above the insole. The insert 100 may also be inserted into boots. For example, the insert 100 can retain the shape of the front portion and/or may retain the shape of the calf portion of the boot and keep the calf portion from falling down. The insert 100 can be inflated before and/or after it is inserted into the shoe.

While reference is made to the insert's various inflation heights in the H-direction and medial-lateral widths in the ML-direction, it should be understood that these components may be referred to as diameters of the insert 100. For example, in embodiments in which the insert 100 has a column-like configuration, the inflation height H and medial-lateral width ML can be substantially equal (e.g., equal) to one another. For example, cross-sections taken along the medial-lateral direction may be substantially circular, having a diameter. In some embodiments, the diameter in the front region 102 is greater than a diameter in the posterior retention portion 104.

Figure 3A:
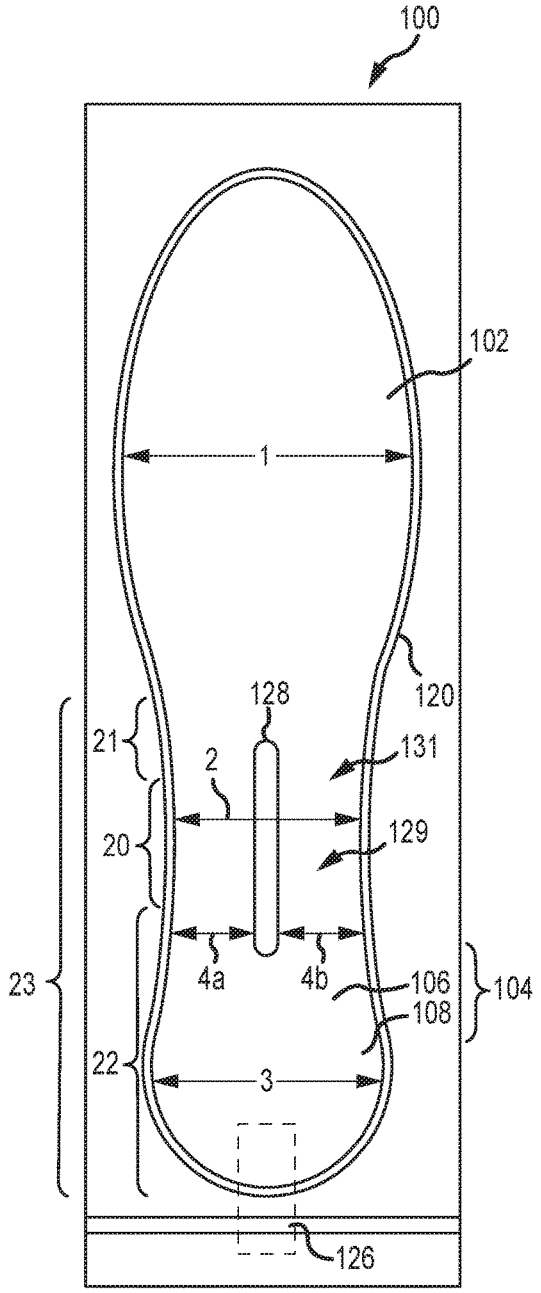
FIG. 3A is a top view of a shoe insert in an uninflated condition.
Figure 3B:
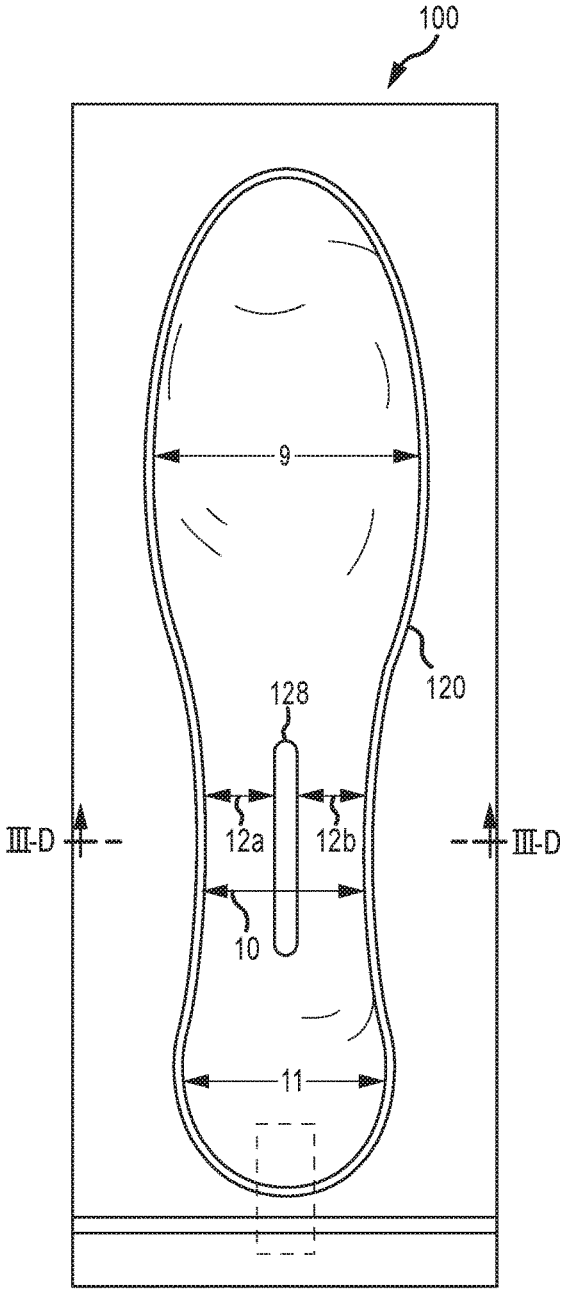
FIG. 3B is a top view of a shoe insert in an inflated condition.
Figure 3C:
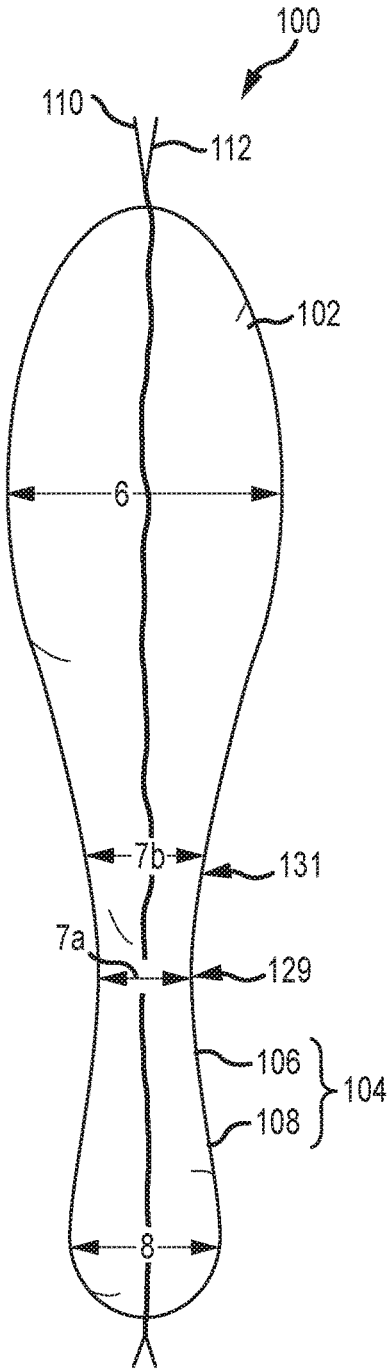
FIG. 3C is a side view of the shoe insert in an inflated condition.
Figure 3D:
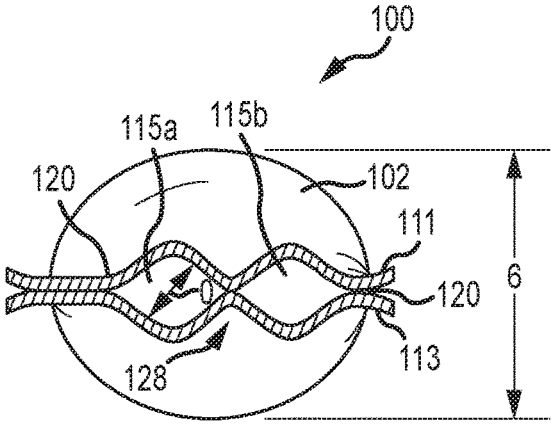
FIG. 3D is a cross-sectional view of the shoe insert taken along plane IIID-IIID in FIG. 3B.

FIGS. 3A and 3B are top views of a shoe insert in an uninflated condition and an inflated condition, respectively. FIG. 3C is a side view of the shoe insert in the inflated condition. FIG. 3D is a cross-sectional view of the shoe insert taken along plane IIID-IIID in FIG. 3B. Seals 120 define an air chamber 114 that has a front portion 104 and a posterior retention portion. As shown, seal 120 can be curved at the front portion 104, for example, so the insert 100 can accommodate a shoe having a rounded toe. In the embodiment shown in FIGS. 3A-3D, the posterior retention portion 104 is made up of a flexible region 106 and a heel portion 108. For example, the heel portion 108 has a medial-lateral width 3 and an inflation height 8 that is greater than a medial-lateral width 2 and inflation height 7 of the middle region 106, but that is less than a medial-lateral width 1 and inflation height 6 of the front region 102. In some embodiments, the medial-lateral width 2 of the flexible region 106 is less than ¾ as large as the medial-lateral width 1 of the front region 102. For example, medial-lateral width 2 of the flexible region 106 may be ⅔, ½, or ⅓ the value of the medial-lateral width 1 of the front region 102. The medial-lateral width 2 of the flexible region 106 may be at least ⅕ the value of the medial-lateral width 1 of the front region 102 to provide sufficient rigidity. As shown in FIG. 3B, in the inflated condition, the front region 102 has a medial-lateral width 13, the flexible region 106 has a medial-lateral width 14, and the heel portion 106 has a medial-lateral width 15.

In some embodiments, to further increase the flexibility of the posterior retention portion 104, the insert 100 includes one or more intermediate seals 128 that seal together the web plies 110,112 to reduce the inflation height 10 of the posterior retention portion 104. The intermediary seal 128 pinches together the plies 110,112 to form a pinched region 129 that demonstrates increased flexibility. Thus, the intermediary seal 128 focuses bending of the posterior retention portion 104 to the pinched region 129. In some embodiments, the intermediary seal 128 extends all the way back to the seal 120 at posterior edge 126. But as shown in FIG. 3A, in preferred embodiments, the intermediary seal 128 is surrounded on all sides by fluid in the posterior retention portion 104. The intermediary seal 128 can be disposed within the posterior retention portion 104 at a distance 21 from the front region 102 along the posterior-anterior direction. A curved region 131 can extend between the anterior end of the intermediary seal 128 and the posterior end of the front region 102. The intermediary seal 128 has a posterior-anterior length 20 within the flexible region 104, and can be spaced from the posterior edge 126 of the seal 120 at a distance 22. In preferred embodiments, the posterior-anterior length 20 of the intermediary seal 128 is less than ½ the distance 23 of the posterior retention portion 104. For example, in some embodiments, the length 20 of the intermediary seal 128 is less than ⅓ the distance 23 of the posterior retention portion 104. In some embodiments, the distance 21 between the front region 102 and the intermediary seal 128 is less than the distance 22 between the intermediary seal 128 and the posterior edge 126 of the seal 120. As shown in FIG. 3C, in some embodiments, the flexible region 106 has an inflation height 7*b* that is less than the front region, and the pinched region 129 has a further reduced inflation height 7*a*. The inflation height 7*a*,7*b* of the flexible region 106 is reduced based on the spacing between the intermediary seal 128 relative to the seals 120 in the medial-lateral direction. Thus, the intermediate seal 128 facilitates the retention portion 104 in flexing and bending, to fit various shoe sizes.

In some embodiments, the inflation height 7*a* of the pinched region 129 is less than ⅔ the value of the inflation height 8 of the heel portion 108. In some embodiments, the inflation height 7*a* of the pinched region 129 is less than ½ the value, less than ⅓, ⅕, or ⅐ the value of the inflation height 8 of the heel portion 108. In some embodiments, the inflation height 7*a* of the pinched region 129 is less than ½ the value of the inflation height 6 of the front region 102. In some embodiments, the inflation height 7*a* of the pinched region 129 is less than ¼, ⅙, ⅛, or 1/10 the value of the inflation height 6 of the front region 102. In some embodiments, the inflation height 7*a* of the pinched region 129 is less than ¾ the value of the inflation height 7*b* of the curved region 131. In some embodiments, the inflation height 7*a* of the pinched region 129 is less than ⅓ the value, or less than a ½ the value of the inflation height 7*b* of the curved region 131.

FIG. 3D shows a cross-sectional view of the insert 100 taken along plane IIID-IIID in FIG. 3B. As shown in FIG. 3D, tubes 115*a*,115*b* are formed in a portion of the air chamber 114 by the intermediate seal 128 the seals 120. These formed tubes 115 provide the pinched region 129 with a reduced inflation height 7*a* and thus improved its ability to flex and bend.

The various inflation heights depend on distances between adjacent seals. For example, the inflation height 8 of the heel portion 108 (FIG. 3C) depends on the configuration of the seal 120 and also on the placement of the intermediate seal 128 (e.g., distance 22 in FIG. 3A). In the embodiment shown in FIGS. 3A and 3D, the tubes 115 have a circular cross-section having a diameter D, which is based on the distance between adjacent seals. For example, the diameters of tubes 115*a*,115*b* are based on the medial-lateral widths 4*a*,4*b* between seal 120 and the intermediate seal 128. In the embodiment shown in FIG. 3D, the diameters D of tubes 115*a*,115*b* are substantially equal to one another.

In some embodiments, the insert 100 does not include any intermediary seals 128. In some embodiments, the insert 100 includes a plurality of intermediary seals 128. For example, in some embodiments, two or more intermediary seals 128 lie next to one another in along the medial-lateral direction of the posterior retention portion 104, for example, to form more than two tubes 115. In some embodiments, two or more intermediary seals 128 extend another along the posterior retention portion 104.

FIG. 3D shows portions 111,113 of the web plies 110,112 located outside of the seal 120; these portions 111,113 may be removed from the insert 100 (e.g., cut off from the insert 100) or left on the insert 100.

Figure 4A:
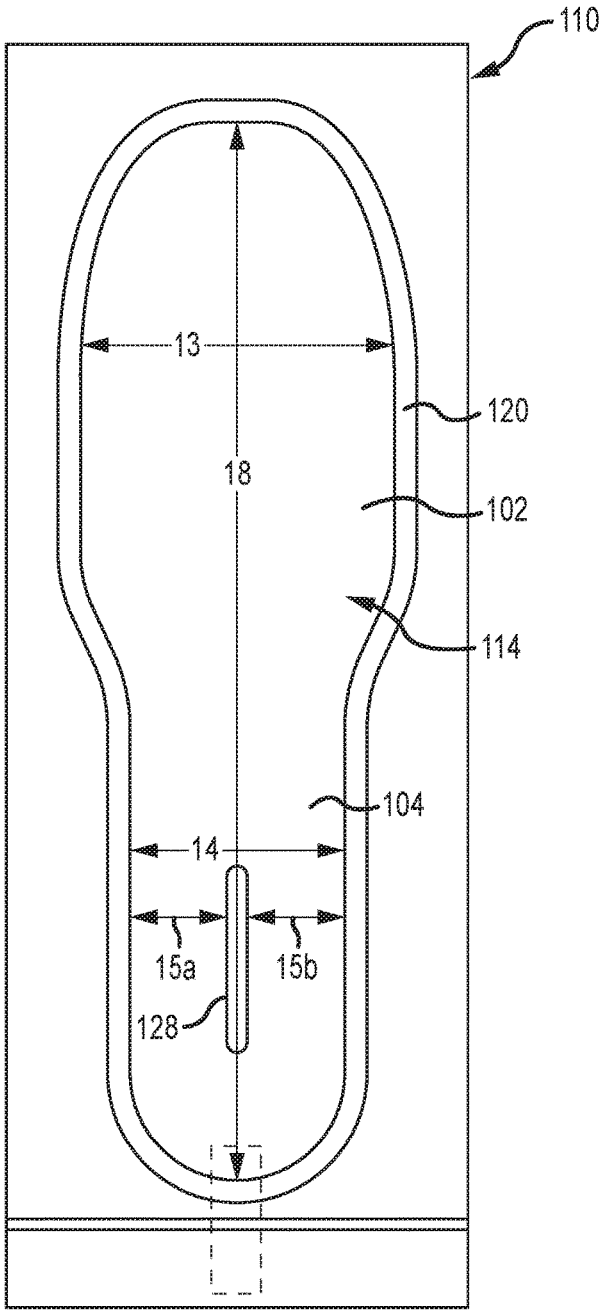
FIG. 4A is a top view of a shoe insert in an uninflated condition.
Figure 4B:
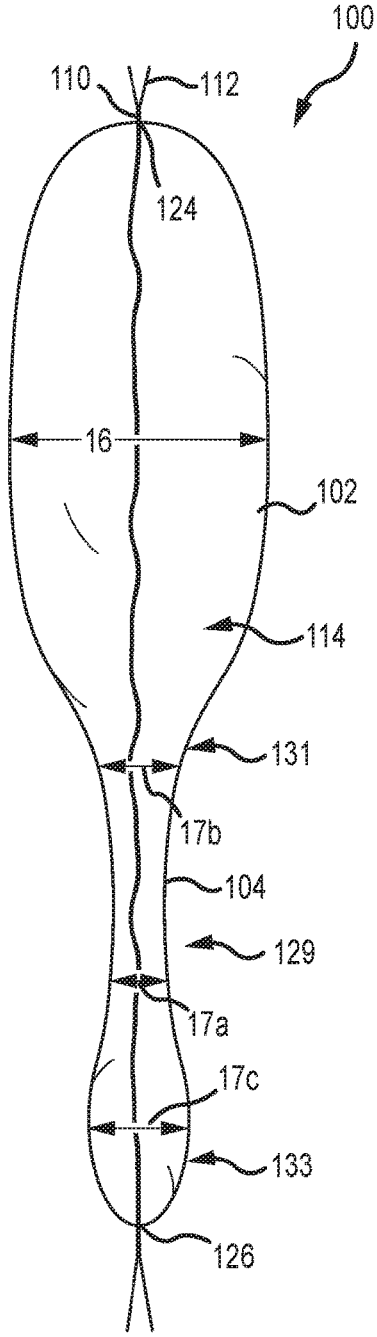
FIG. 4B is a side view of a shoe insert in an inflated condition.

FIG. 4A is a top view of an embodiment of a shoe insert 100 in an uninflated condition. FIG. 4B is a side view of the shoe insert 100 in an inflated condition. The insert 100 is formed of a first web ply 110 and a second web ply 112. FIG. 4A shows a seal 120 that extends in a closed loop to define the boundary of an air chamber 114. The posterior retention portion is defined by medial and lateral seals (which can be sections of seal 120) that extend substantially parallel to one another until they converge towards one another at a posterior edge 126. An intermediary seal 128 pinches together the plies 110,112 within the posterior retention portion 104 to form a pinched region 129 with increased flexibility.

The air chamber 114 has a posterior-anterior length 18 (when in an uninflated condition) that extends from a posterior edge 126 of the seal 120 to an anterior edge 124 of the seal 120. When inflated with a fluid (e.g., air), the air chamber 114 has an inflation height that varies throughout the posterior-anterior length of the inflation chamber 114. In this embodiment, the front region 102 has an inflation height 16 that is greater than the inflation height 17 of the retention portion 104. The toe region 102 has an inflated medial-lateral width that is greater than the inflated medial-lateral width of the retention portion 106. Intermediate seal 128 seals together the web plies 110,112 within the posterior retention portion 104. As explained above with reference to FIG. 3D, tubes are formed between adjacent seals 120,128. In some embodiments, the distances in the medial-lateral direction 15*a*-15*b* between adjacent seals 120,128 are substantially equal to one another. As described above, the intermediate seal 128 further reduces the inflation height 17 of the retention portion 104 and improves its ability to bend and flex.

The intermediary seal 128 can be disposed in the posterior retention portion 104 with a first curved region 131 extending between the pinched region 129 and the front region 102, and a second curved region 133 extending between the pinched region 129 and the posterior edge 126 of the seal 120. The pinched region 129 has an inflation height 17*a* that is less than the inflation heights of both the first and second curved regions 131, 133. The pinched region 129 facilitates flexing and bending of the retention portion 104 to allow a user to bend the insert (e.g., at a 90 degree angle) to fit the insert 100 into shoes of various sizes and shapes.

Figures 5A, 5B, 5C, 5D, 5E, 5F:
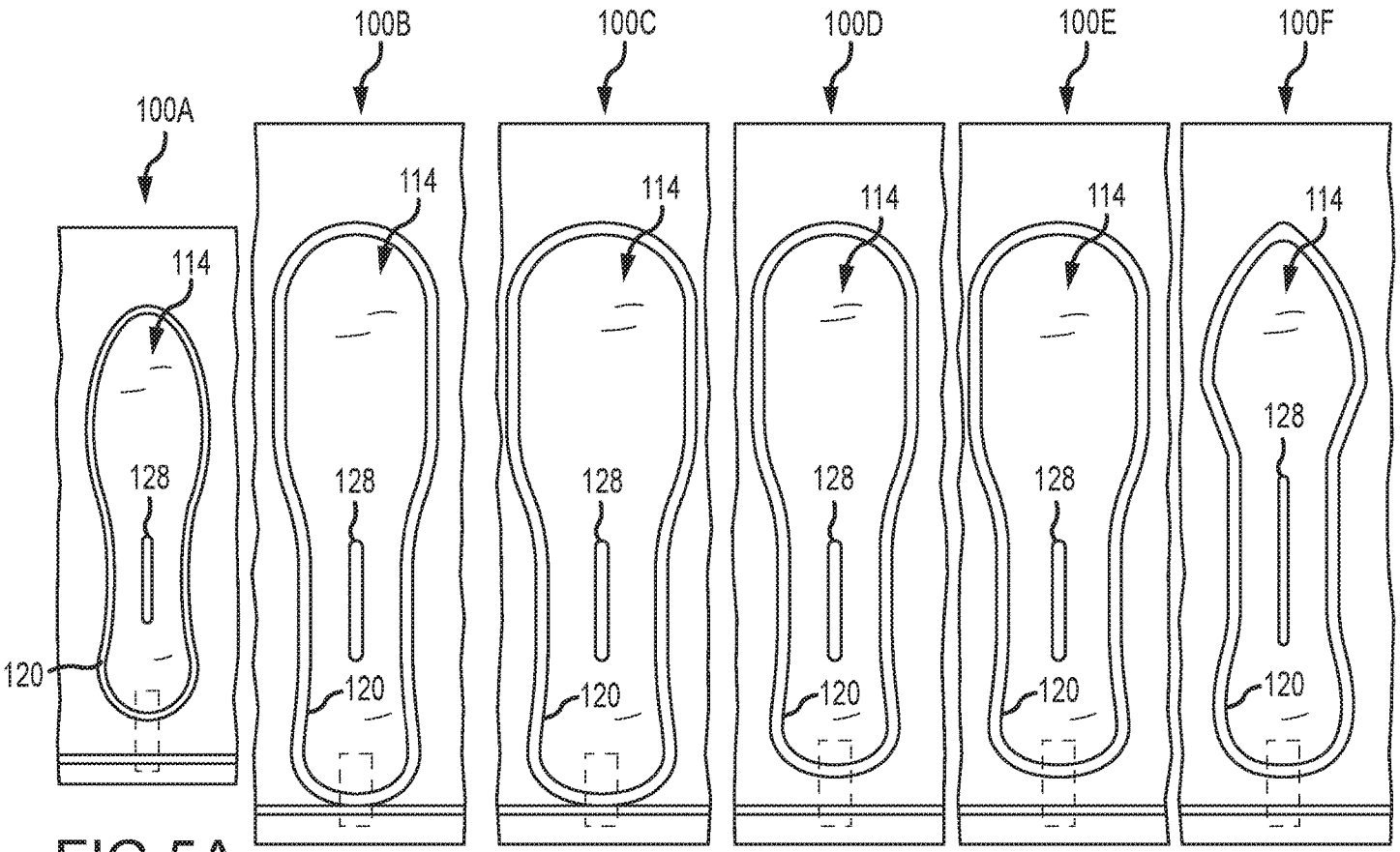
FIGS. 5A-5F show various embodiments of shoe inserts.

FIGS. 5A-5F show top views of various embodiments of shoe inserts 100. FIG. 5A shows a shoe insert 100A that has a smaller configuration, which can be suitable for children's shoes. For example, the insert 100A may be configured for retaining the shape of a shoe having a shoe cavity 206 length in the PA-direction ranging from 3-9 inches (e.g., the shoe insert 100A may have a PA length ranging from 3-12 inches when in the inflated condition). FIGS. 5B-5F show inserts 100B-100F that have larger configurations, and which are suitable for adult shoes. In embodiments, the inserts 100B-100F are configured for retaining the shape of shoes having a shoe cavity 206 length in the posterior-anterior direction ranging from 9-12 inches (e.g., the shoe inserts 100B-100F may have a PA length ranging from 9-16 inches when in the inflated condition). FIGS. 5B and 5C show inserts 100B, 100C that may be suitable for men's shoes. The insert 100B shown in FIG. 5B has a seal 120 with a narrower configuration than the insert 100C shown in FIG. 5C, and may be suitable for shoes 200 having a more narrow shoe cavity 206. FIGS. 5D-5F show inserts 100D-100F that may be suitable for women's shoes. The insert 100D shown in FIG. 5D has a narrower configuration than the insert 100E shown in FIG. 5E, and may be suitable for shoes 200 having a more narrow shoe cavity 206. The insert 100F shown in FIG. 5F has a shorter front region 102, and may be suitable for women's shoes that have a low-cut shoe box, such as ballet flats, pumps, or court shoes.

Figure 6A:
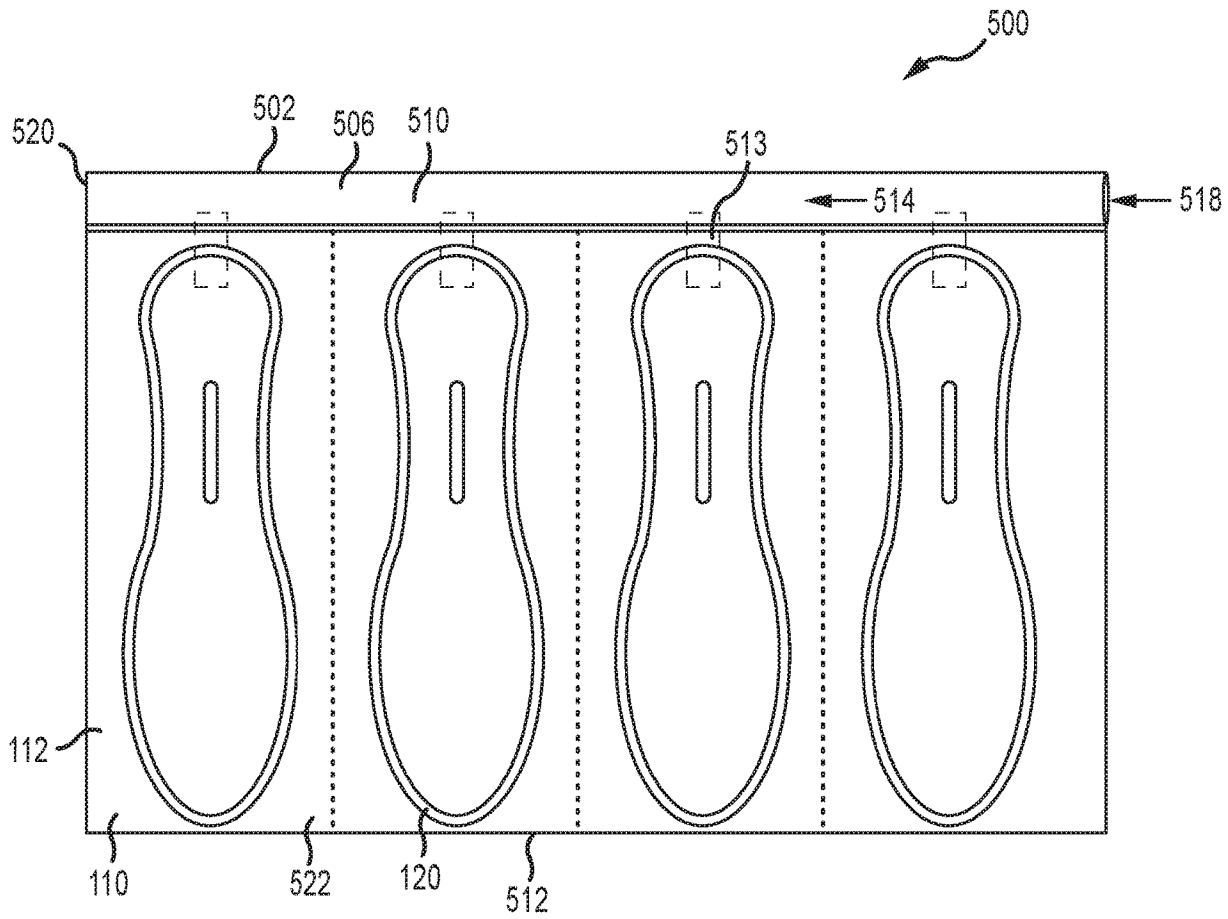
FIG. 6A is a top view of an uninflated material web, according to an embodiment.
Figure 6B:
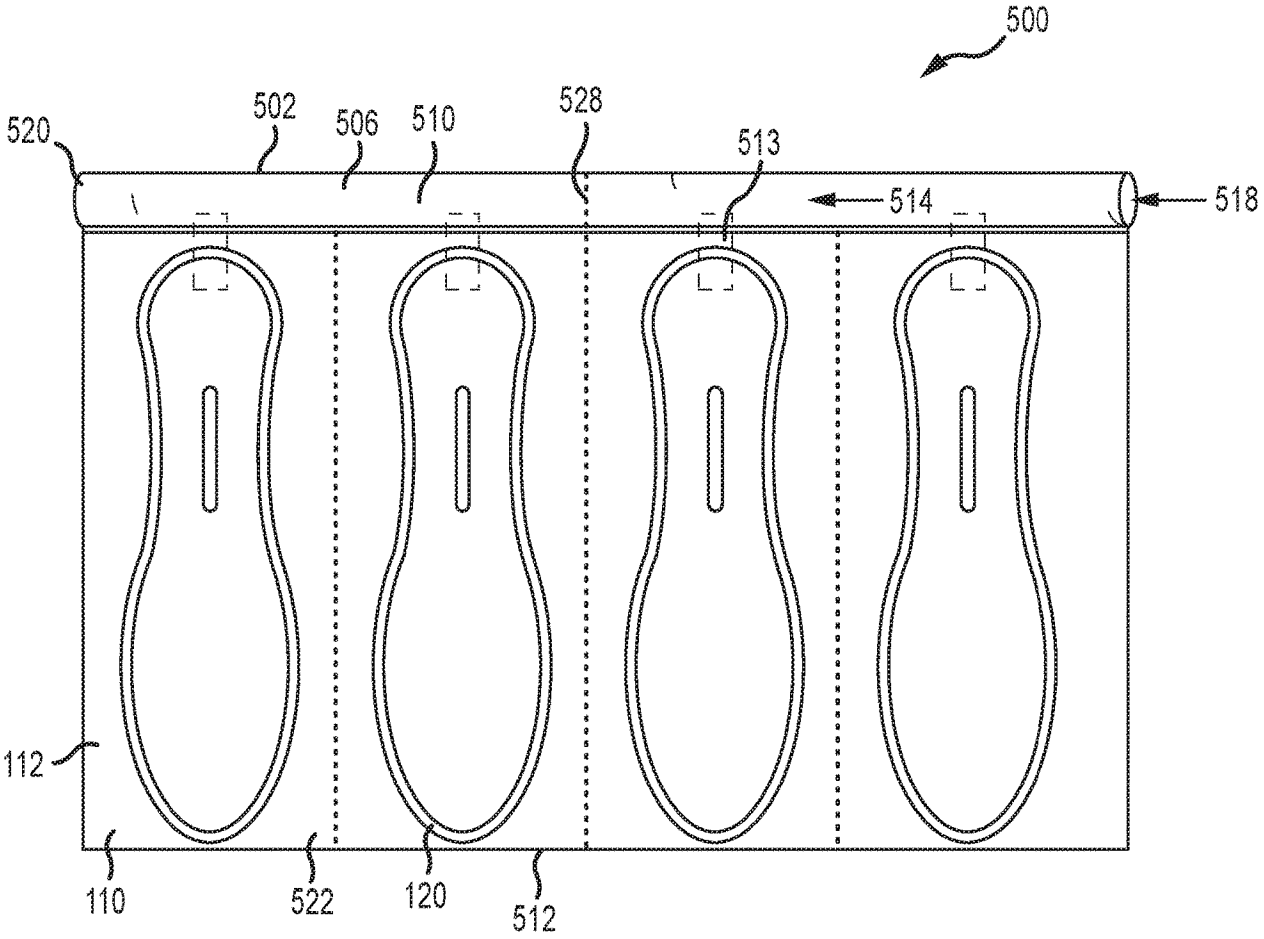
FIG. 6B is a top view of an uninflated material web, according to an embodiment.

FIGS. 6A and 6B show an embodiment of a web 500 of film from which the inserts 100 (e.g., the inserts 100 shown in FIGS. 1A-1B, 2, 3A-3D and 4A-4B) can be made. The web 500 includes a first web ply 110 having a first longitudinal edge 502 and a second longitudinal edge 504; and a second web ply 112 having a first longitudinal edge 506 and a second longitudinal edge 508. The second web ply 112 is aligned to be over lapping and can be generally coextensive with the first web ply 110, e.g., at least respective first longitudinal edges 502,506 are aligned with each other and/or second longitudinal edges 504,508 are aligned with each other. The plies 110, 112 can be partially overlapping with one or more air chambers 114 in the region of overlap. FIGS. 6A and 6B illustrate a top view of the web 500 having first and second plies 110,112 joined at a first longitudinal web seal 510 and a second longitudinal web seal 512.

The first and second web plies 110,112 can be formed from a single sheet of web material, a flattened tube of web material with one edge slit, or two sheets of web material. For example, the first and second web plies 110,112 can include a single sheet of web material that is folded in a c-fold. Alternatively, for example, the first and second web plies 110,112 can include a tube of web material (e.g., a flatten tube) that is slit along aligned longitudinal edge. Also, for example, the first and second web plies 110,112 can include two independent sheets of web material joined, sealed, or otherwise attached together.

The seals 120,128 can be formed from a variety of techniques known to those of ordinary skill in the art. Such techniques include, but are not limited to, adhesion, friction, welding, fusion, heat sealing, laser sealing, and ultrasonic welding. In some embodiments, at least one of the seals 120,128 is an adhesive seal.

As shown in FIGS. 6A and 6B, in some embodiments, the web 500 includes a series of seals 120 disposed along the longitudinal extent of the web 500. Each air chamber 114 is fluidly connected to the inflation channel 514. In the embodiment shown, each seal 120 extends substantially transversely, toward the second longitudinal web seal 512, although the seals 120 may be positioned at different angles relative to the longitudinal seals 510,512.

In some embodiments, to facilitate separation of adjacent inserts 100, a separation region 522, such as a series of lines of weakness, is disposed along the longitudinal extent of the film and extend transversely across the web 500. Each separation region 522 can extend from the second longitudinal edge 112 and towards the first longitudinal edge 110. In some embodiments, each separation region 522 in the web 500 is disposed between a pair of adjacent chambers 114. The separation region can comprise a transverse line of weakness that facilitates separation of adjacent inserts 100. As shown in FIG. 6B, in some embodiments, the web includes a first separation regions 528 (e.g., first lines of weakness) extending substantially completely across the web between pairs of adjacent air chambers 114. Second separation regions 522 (e.g., lines of weakness) can extend across the web but not past the conduit 514, to separate chambers 114 within each pair. As such, the chambers 114 can be handled as pairs of inserts for inserting into pairs of shoes.

Transverse lines of weakness 522,528 can include a variety of lines of weakness known by those of ordinary skill in the art. For example, in some embodiments, the transverse lines of weakness 522,528 include rows of perforations, in which a row of perforations includes alternating lands and slits spaced along the transverse extent of the row. The lands and slits can occur at regular or irregular intervals along the transverse extent of the row. Alternatively, for example, in some embodiments, the transverse lines of weakness 522 include score lines or the like formed in the web material.

The transverse lines of weakness 522,528 can be formed from a variety of techniques known to those of ordinary skill in the art. Such techniques include, but are not limited to, cutting (e.g., techniques that use a cutting or toothed element, such as a bar, blade, block, roller, wheel, or the like) and/or scoring (e.g., techniques that reduces the strength or thickness of material in the first and second web layers, such as electromagnetic (e.g., laser) scoring and mechanical scoring).

Preferably, the longitudinal inflation channel 514 extends longitudinally along web 500 and an inflation opening 518 is disposed on one end of the longitudinal inflation channel 514, the other end of the inflation channel 514 being sealed via end seal 520. One-way valves (e.g., check valves) 513 extend from the fluid conduit 514 and into the air chambers 114, to fluidly connect the fluid conduit 514 to the air chambers 114. Thus, a user can fill the air chambers 114 by inserting an inflation nozzle 720 (shown in FIG. 7) through opening 518.

Figure 7:
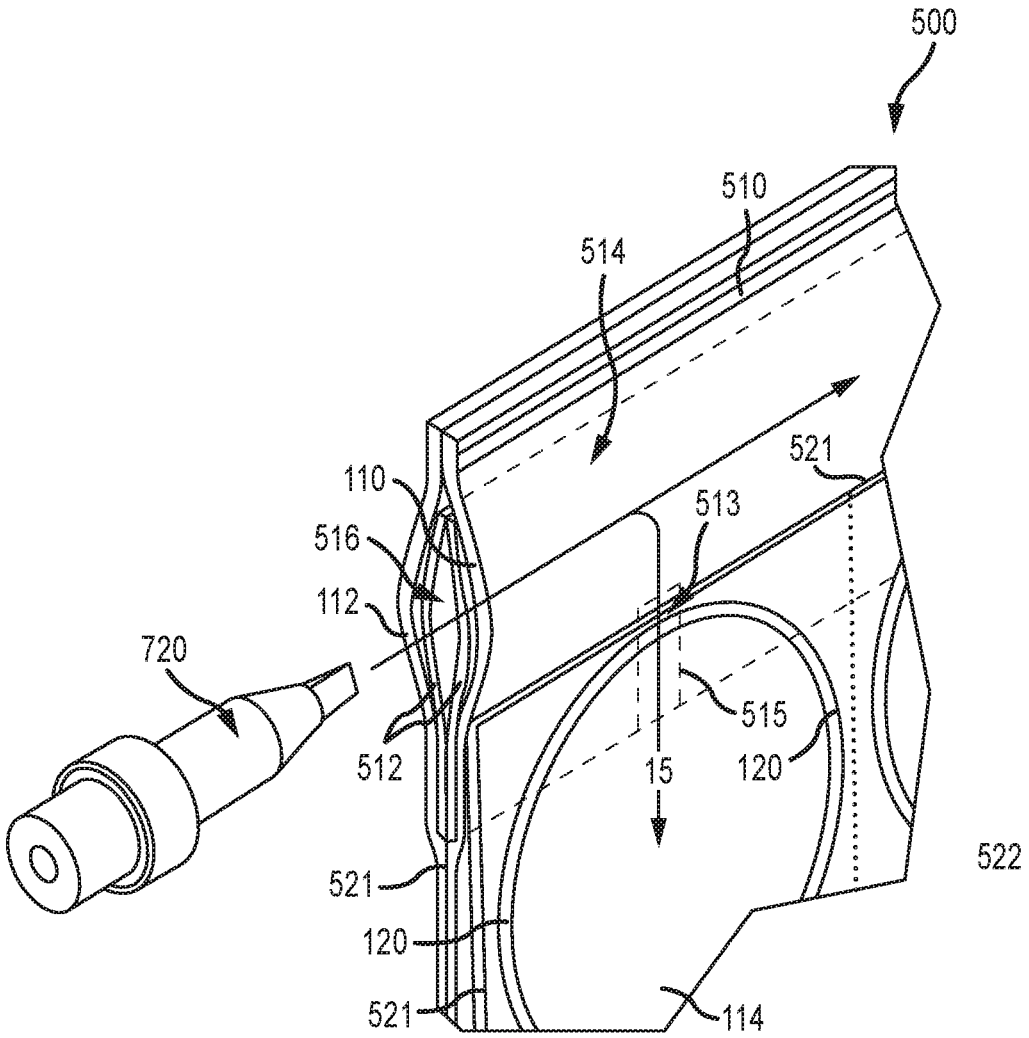
FIG. 7 is a perspective view of a material web and an inflation nozzle, according to an embodiment.

FIG. 7 shows an inflation nozzle 720 and a web 500 made of plies 110,112 that are sealed together to define a inflation channel 514, which is preferably flexible and normally in a collapsed state. Transverse seal portions 120 define inflatable air chambers 114 that are in fluid communication with the filler conduit 514 via one-way valves 513. The air chambers 114 for the inserts 100 may be configured as described above.

A filling opening or aperture 516 is located at one end of the inflation channel 514. The aperture 516 is defined by the plies 110,112 and is configured and dimensioned for receiving the inflation nozzle 720 therein. Preferably, the inflation nozzle 720 is sized to have a friction fit with the aperture 516. In one embodiment, the inflation nozzle 720 has an interference fit with the aperture 516. Located partially within the aperture 516 and inflation channel 514, and extending partially into each of the air chambers 114, is another set of sheets 512, which are also sealed at areas 521, except at valve areas 515 to define one-way check-valves 513 between the areas 515, configured to let air into the air chambers 114 and seal it therein. The unsealed areas between sheets 512 that define the check-valves 513 are preferably kept unsealed during the sealing operation that seals inner sheets 512 to plies 110,112 by printing (e.g., with ink) on the areas to remain unsealed.

Each of the one-way check-valves 513 fluidly connects the fluid conduit 514 to an air chamber 114. In the uninflated state, the aperture 516 is closed and flat, and the check-valves 513 are in a closed position. Upon opening of the aperture 516 by the inflation nozzle 720, air can be delivered into the fluid conduit 514. Preferably, the operating pressure at which the air is delivered into the fluid conduit 514 opens the check-valves 513 to allow air to pass into the air chambers 114. Once inflation of the each air chamber 114 is complete, the pressure of the air within each air chamber 114 acts against the check-valves 513 to keep the valves in the closed position, thus preventing air from escaping and the cushion from deflating.

The web 500 may have any suitable number of air chambers 114. For example, the web 500 can include one chamber 114, two chambers 114, twenty chambers 114, etc. In preferred embodiments, the number of chambers 114 included in the web is divisible by two, in order to accommodate pairs of shoes. The fluid (e.g., air) may be regulated to be equal to or greater than atmospheric pressure. For example, the air may be regulated to be greater than 1 psi and less than 14 psi. For example, the air may be regulated to be between 3 to 8 psi.

Figure 8:
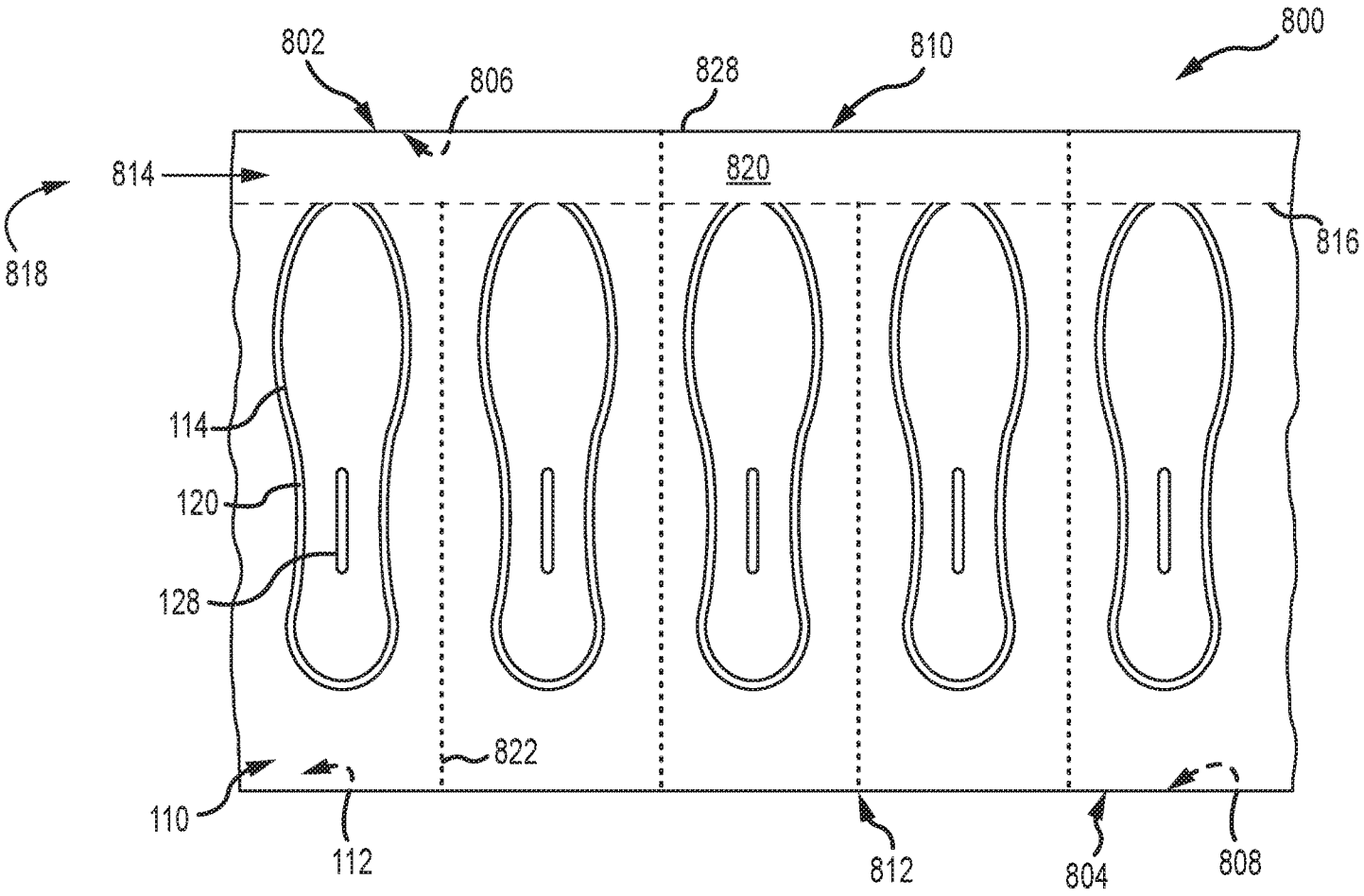
FIG. 8 is a top view of an uninflated material web according to an embodiment.
Figure 9:
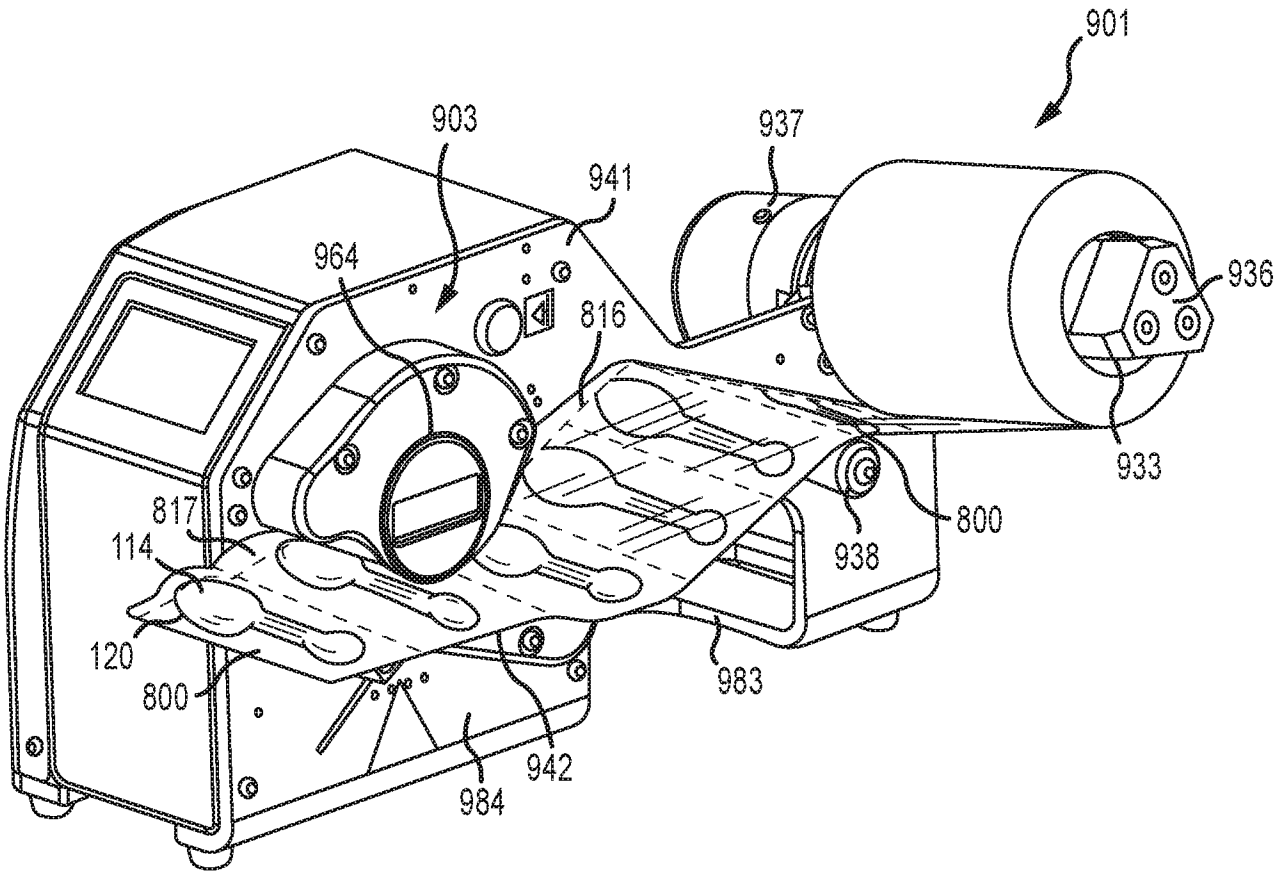
FIG. 9 is an example packaging inflation and sealing device for use in producing the shoe inserts, according to an embodiment.

While FIGS. 6A and 6B shows the heel portions 108 of inserts 100 being proximate the fluid conduit 514, it should be understood that the air chambers 114 may be arranged in other configurations. For example, as shown in FIGS. 8 and 9, in some embodiments, the front region 102 is proximate the fluid conduit 514 and the heel portions 108 are distal from the fluid conduit 514. Also, in some embodiments, the fluid conduit 514 is located distally from the longitudinal edges 510,512 of the web 500 (e.g., in the middle of the web 500) so that air chambers 114 extend transversely in both directions of the conduit 514.

FIG. 8 is a top view of an uninflated material web 800 from which inserts 100 can be formed, according to another embodiment. The web 800 is made of first ply 110 having a first longitudinal edge 802 and a second longitudinal edge 804, and a second ply 112 having a first longitudinal edge 806 and a second longitudinal edge 808. The second web ply 112 is aligned to be over lapping and can be generally coextensive with the first web ply 110, e.g., at least respective first longitudinal edges 802,806 are aligned with each other and/or second longitudinal edges 804,808 are aligned with each other. The plies 110, 112 are at least partially overlapping with one or more air chambers 114 that are defined by seals 120,128 in the region of overlap. FIG. 8 illustrates a top view of the web 800 having first and second plies 110,112 joined at a first longitudinal web seal 810 and a second longitudinal web seal 812.

The first and second web plies 110,112 can be formed from a single sheet of web material, a flattened tube of web material with one edge slit, or two sheets of web material. For example, the first and second web plies 110,112 can include a single sheet of web material that is folded in a c-fold. Alternatively, for example, the first and second web plies 110,112 can include a tube of web material (e.g., a flatten tube) that is slit along aligned longitudinal edge. Also, for example, the first and second web plies 110,112 can include two independent sheets of web material joined, sealed, or otherwise attached together.

As shown in FIG. 8, each air chamber 114 is in fluid communication with an inflation region (e.g., a longitudinal inflation channel 814) via a mouth 820 that opens towards the inflation region, thus permitting inflation of the inflatable chambers 114. While FIG. 8 shows the front region 102 of inserts 100 being proximate the inflation channel 814, it should be understood that the air chambers 114 may be arranged in other configurations. For example, the proximate retention portion 104 may be proximate the inflation channel 814 and the front region 102 may be distal from the inflation channel 814.

FIG. 9 illustrates an example of an inflatable packaging sealing device 901 that may be operated to convert a web 800 of uninflated material into a series of inflated shoe inserts 100 by inflating the air chambers 114. As shown in FIG. 9, the uninflated web 800 can be a bulk quantity of supply, for example a roll of web 800 that is rolled around an inner support tube 933.

The inflation and sealing device 901 may include a bulk material support 936. The bulk quantity of uninflated web 800 may be supported by the bulk material support 936. For example, the bulk material support 936 may be a tray operable to hold the uninflated web 800, which can be provided by a fixed surface or a plurality of rollers, for example. To hold a roll of web 800, the tray may be concave around the roll or the tray may convex with the roll suspended over the tray. The bulk material support 936 may include multiple rollers which suspend the web 800. The bulk material support 936 may include a single roller that accommodates the center of the roll of web 800. The roll of the web 800 may be suspended over the bulk material support 936, such as a spindle passing through the core 933 of the roll of the web 800. Typically, the roll core is made of cardboard or other suitable materials.

In accordance with various embodiments, a nozzle inflates web 800 through inflation opening 814 and into the inflation channel 814, as described above. The web 800 may roll off of material support 836 and over guide 838 in a manner that aligns the inflation channel 814 of the web 800 with the nozzle in inflation area 842.

In embodiments, the inflation and sealing device 901 is configured for continuous inflation of the web 800 as it is unraveled from the roll. The roll of web 800 includes the plurality of air chambers 114 that are arranged in series. To begin manufacturing of the inflated shoe inserts 100 from the web 800, the inflation opening 818 of the web 800 is inserted around an inflation assembly, such as an inflation nozzle in inflation region 942. The web 800 is advanced over the inflation nozzle with the air chambers 114 extending transversely with respect to the inflation nozzle and an outlet on the inflation nozzle. The outlet, which can be disposed on a radial side and/or the upstream tip of the nozzle, for example, directs fluid from a nozzle body into the air chambers 114 to inflate the air chambers 114 as the web 800 advances along the material path in a longitudinal direction.

The inflation nozzle inserts fluid, such as pressured air, along a fluid path into the uninflated web material through nozzle outlets, inflating the material into inflated inserts or chambers 114. The inflation nozzle can include a nozzle inflation channel that fluidly connects a fluid source with the nozzle outlets. It is appreciated that in other configurations, the fluid can be other suitable pressured gas, foam, or liquid. The web 800 is fed over the inflation nozzle, which directs the web to the inflation and sealing assembly 903. The web 800 is advanced or driven through the inflation and sealing device 901 by a drive mechanism, such as by a driver or sealing drum or the drive roller, in a downstream direction along a material path.

After being fed through the web feed area 964, the sealing mechanism then forms a seal 817 at the sealing location 816 of the inflated web 800 to close the mouth 820 of each air chamber 114. A sealing drum may include heating elements, such as thermocouples, which melt, fuse, join, bind, or unite together the two plies 110,112, or other types of welding or sealing elements. The web 800 is continuously advanced through the sealing assembly along the material path and past the sealing drum at a sealing area to form a continuous longitudinal seal along the web by sealing the first and second plies 110,112 together at seal region 816. The seal region 816 abuts seal 120 so that when the plies 110,112 are sealed along the seal region 816, a seal 817 is formed to seal the mouths 820 shut, thereby forming a continuous seal around the air chamber 114.

The fluid (e.g., air) may be regulated to be equal to or greater than atmospheric pressure. For example, air may be regulated to be at least 1 psi and less than 14 psi. For example, air may be regulated to be between 3 to 8 psi.

In some embodiments, the web plies 110,112 are between 10 and 100 microns thick. In preferred embodiments, the web plies 110,112 are at least 20 microns thick. For example, the web plies 110,112 may be between 50 and 75 microns thick.

The web plies 110,112 can be formed from any of a variety of suitable web materials known to those of ordinary skill in the art. Such web materials include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof.

In preferred embodiments, the web plies 110,112 are made from a co-extruded material that contains nylon. For example, the web plies 110,112 may be made from polyethylene and nylon. The inventors found that materials containing nylon serve as an air barrier and retain the air over the shipping and storage cycle of shoes. Other suitable materials and constructions can be used.

The disclosed multiply web 500,800 may be made of a monolayer or multilayer film material. The one or more layers may include polymers of differing compositions. In some embodiments, the disclosed layers may be selected from ethylene, amide, or vinyl polymers, copolymers, and combinations thereof. The disclosed polymers can be polar or non-polar. The disclosed ethylene polymers may be substantially non-polar forms of polyethylene. In many cases the ethylene polymer may be a polyolefin made from copolymerization of ethylene and another olefin monomer, for example an alpha-olefin. The ethylene polymer may be selected from low, medium, or high density polyethylene, or a combination thereof. In some cases, the density of various polyethylenes may vary, but in many cases the density of low density polyethylene may be, for example, from about 0.905 or lower to about 0.930 g/cm3, the density of medium density polyethylene may be, for example, from about 0.930 to about 0.940 g/cm3, and high density polyethylene may be, for example, about 0.940 to about 0.965 g/cm3 or greater. The ethylene polymer may be selected from linear low density polyethylene (LLDPE), metallocene linear low density polyethylene (mLLDPE), high density polyethylene (HDPE), medium density polyethylene (MDPE), and low density polyethylene (LDPE).

In some embodiments, the polar polymer may be a non-polar polyethylene which may be modified to impart a polar characteristic. In other embodiments the polar polymer is an ionomer (e.g. copolymers of ethylene and meth acrylic acid, E/MAA), a high vinyl acetate content EVA copolymer, or other polymer with polar characteristics. In one embodiment the modified polyethylene may be anhydride modified polyethylene. In some embodiments, the maleic anhydride is grafted onto the olefin polymer or copolymer. Modified polyethylene polymers may react rapidly upon coextruding with polyamide and other ethylene containing polymers (e.g., EVOH). In some cases a layer or sublayer comprising the modified polyethylene may form covalent bonds, hydrogen bonds and/or, dipole-dipole interactions with other layers or sublayers, for example sublayers or layers comprising a barrier layer. In many embodiments, modification of a polyethylene polymer may increase the number of atoms on the polyethylene that are available for bonding. For example, modification of polyethylene with maleic anhydride adds acetyl groups to the polyethylene, which may then bond with polar groups of the barrier layer, for example hydrogen atoms on a nylon backbone. Modified polyethylene may also form bonds with other groups on the nylon backbone as well as polar groups of other barrier layers, for example alcohol groups on EVOH. In some embodiments, a modified polyethylene may form chain entanglements and/or van der Waals interactions with an unmodified polyethylene.

The layers of the plies 110,112 may be adhered or otherwise attached together, for example, by tie layers. In other embodiments, one or more of the plies 110,112 are a single layer of material, for example, a polyethylene layer.

Mixtures of ethylene and other molecules may also be used. For example, ethylene vinyl alcohol (EVOH) is a copolymer of ethylene and vinyl alcohol. EVOH has a polar character and can aid in creating a gas barrier. EVOH may be prepared by polymerization of ethylene and vinyl acetate to give the ethylene vinyl acetate (EVA) copolymer followed by hydrolysis. EVOH can be obtained by saponification of an ethylene-vinyl acetate copolymer. The ethylene-vinyl acetate copolymer can be produced by a known polymerization, such as solution polymerization, suspension polymerization, emulsion polymerization and the like, and saponification of ethylene-vinyl acetate copolymer can be also carried out by a known method. Typically, EVA resins are produced via high pressure autoclave and tubular processes.

Polyamide is a high molecular weight polymer having amide linkages along the molecular chain structure. Polyamide is a polar polymer. Nylon polyamides, which are synthetic polyamides, have favorable physical properties of high strength, stiffness, abrasion and chemical resistance, and low permeability to gas, for example oxygen.

In accordance with various embodiments, these components and other components which may be utilized within an inflation and sealing device including without limitation, the nozzle, blower sealing assembly, and drive mechanisms, and their various components or related systems may be structured, positioned, and operated as disclosed in any of the various embodiments described in the incorporated references such as, for example, U.S. Pat. No. 8,061,110; U.S. Pat. No. 8,128,770; U.S. Patent Publication No. 2014/0261752; and U.S. Patent Publication No. 2011/0172072 each of which is herein incorporated by reference. Also, the various systems, materials, processes, and components described in U.S. Pat. No. 7,926,507 may be used, which is hereby incorporated by reference in its entirety. Also, the webs described herein may be formed as disclosed in U.S. Application Publication No. 2015/0033669, which is hereby incorporated by reference in its entirety. Each of the embodiments discussed herein may be incorporated and used with the various sealing devices of the incorporated references and/or other inflation and sealing devices. For example, any mechanism discussed herein or in the incorporated references may be used in the inflation and sealing of web 500 as the web or film material described in the incorporated references.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A web for an inflatable shoe insert for inserting in a shoe, comprising:

first and second web plies that are sealed together at a plurality of seals that define:

a plurality of air chambers therebetween, and an inflation area connecting the air chambers to direct the fluid into the air chambers to inflate the chambers, the web including:

a first separation region extending across at least a portion of the web between a first pair of adjacent air chambers, the first separation region facilitating separation of the air chambers of the first pair from each other, and a second separation region extending across the web between a second of adjacent air chambers, the second separation region facilitating partial separation of the air chambers of the second pair from each other while leaving the air chambers of the second pair attached at the inflation area, wherein the second separation region extends across a smaller portion of the web than the first separation region making it more difficult to fully separate the web along the second separation region, wherein the first and second separation regions comprise first and second lines of weakness that facilitate the separation by tearing.

2. The web of claim 1, wherein the plurality of seals are configured so that the air chambers include:

a front region having a toe expansion region that is uninterrupted by seals over an area that is sufficiently large so that when fully inflated, the front region expands to an inflation height and a medial-lateral width sufficient to support a shoe upper of the shoe against collapsing; and a posterior retention portion in fluid communication with the front region and having an retention expansion region in which the seals are spaced closer together than in the toe expansion region so that when fully inflated, the posterior retention portion expands to a medial-lateral width that is smaller than that in the toe expansion region, the posterior retention portion having an anterior-posterior length configured to reach the heel of the shoe to retain the front region in the toe box by pressure against the heel.

3. The web of claim 2, wherein, when fully inflated, the posterior retention portion expands to an inflation height that is smaller than that in the toe expansion region.

4. The web of claim 3, wherein at least one intermediate seal seals together the first and second web plies within the posterior retention portion.

5. The web of claim 2, wherein, when fully inflated, the front region expands to a medial-lateral width that is sufficient to contact medial and lateral interior portions of the shoe.

6. The web of claim 2, wherein, when fully inflated, the air within the air chamber has an air pressure above atmospheric pressure.

7. The web of claim 2, wherein the posterior retention portion comprises a flexible region and a heel portion.

8. The web of claim 7, wherein, when fully inflated, the heel portion expands to an inflation height and a medial-lateral width that are both greater than those in the flexible region.

9. The web of claim 8, wherein, when fully inflated, the heel portion expands to an inflation height that is at least twice the inflation height of the flexible region.

10. The web of claim 2, wherein the posterior retention portion is defined by medial and lateral seals that extend substantially parallel to one another until they converge towards one another near a posterior edge of the air chamber.

11. An assembly, comprising:

a shoe; and the web of claim 2 received within a shoe.

12. The assembly of claim 11, wherein the insert is sufficiently inflated so that a top portion of the insert contacts an upper interior portion of the shoe, and medial and lateral interior portions of the insert contact medial and lateral portions of the shoe.

13. The assembly of claim 11, wherein the posterior retention portion abuts an interior heel portion of the shoe.

14. The assembly of claim 11, wherein a posterior-anterior length of the shoe cavity of the shoe is less than a posterior-anterior length of the insert.

15. The web of claim 1, wherein the second line of weakness extends short of the inflation region.

16. The web of claim 1, wherein the first line of weakness extends across the inflation region.

17. The web of claim 2, wherein the first and second separation regions comprise first and second lines of weakness that facilitate the separation by tearing.

18. The web of claim 17, wherein each air chamber forms a shoe insert having the front region and the posterior retention portion and the first and second separation regions are arranged such that the air chambers tend to be separated as pairs with each pair having an attachment at the inflation region.

* * * * *